US007204654B2

(12) United States Patent
Ahne et al.

(10) Patent No.: US 7,204,654 B2
(45) Date of Patent: Apr. 17, 2007

(54) PERFORATION FORMING MECHANISM FOR USE IN AN IMAGING APPARATUS

(75) Inventors: Adam Jude Ahne, Lexington, KY (US); William Michael Connors, Lexington, KY (US); Douglas Laurence Robertson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 400 days.

(21) Appl. No.: 10/612,792

(22) Filed: Jul. 2, 2003

(65) Prior Publication Data

US 2005/0000337 A1 Jan. 6, 2005

(51) Int. Cl.
*B41J 11/66* (2006.01)

(52) U.S. Cl. ..... 400/621; 400/621.1; 346/24

(58) Field of Classification Search ..... 400/621, 400/621.1

See application file for complete search history.

(56) References Cited

U.S. PATENT DOCUMENTS

| | | | | |
|---|---|---|---|---|
| 3,804,325 A | | 4/1974 | Potter | |
| 4,100,867 A | | 7/1978 | Bass et al. | 112/270 |
| 4,250,780 A | | 2/1981 | Shimizu et al. | |
| 4,257,291 A | | 3/1981 | Buchmann | 83/71 |
| 4,467,525 A | | 8/1984 | Logan et al. | 33/18 B |
| 4,541,337 A | | 9/1985 | Schaul | 101/227 |
| 4,564,470 A | * | 1/1986 | Schmitt | 270/21.1 |
| 4,604,632 A | | 8/1986 | Matsumoto | 346/24 |
| 4,653,942 A | | 3/1987 | Soloveychik et al. | 400/122 |
| 4,794,542 A | | 12/1988 | Prockter et al. | 364/474.02 |
| 4,836,697 A | | 6/1989 | Plotnick et al. | 400/120 |
| 5,000,812 A | | 3/1991 | Murphy | |
| 5,019,028 A | * | 5/1991 | Engel et al. | 493/290 |
| 5,219,183 A | | 6/1993 | McKillip | |
| 5,275,077 A | | 1/1994 | Kobayashi | 83/880 |
| 5,363,123 A | * | 11/1994 | Petersen et al. | 346/24 |
| 5,401,110 A | | 3/1995 | Neeley | |
| 5,526,744 A | | 6/1996 | Meschi | |
| 5,531,530 A | | 7/1996 | Kuramoto et al. | |
| 5,560,725 A | | 10/1996 | Abergel | |
| 5,720,223 A | | 2/1998 | Meschi | |
| 5,776,297 A | | 7/1998 | Edwards et al. | |
| 5,823,691 A | | 10/1998 | Langner | 400/127 |
| 5,823,692 A | | 10/1998 | Tolrud et al. | |
| 5,846,005 A | | 12/1998 | Britz et al. | |
| 5,853,837 A | | 12/1998 | Popat | |
| 5,882,128 A | * | 3/1999 | Hinojosa | 400/593 |
| 5,997,680 A | | 12/1999 | Popat | |
| 6,105,483 A | | 8/2000 | Takeda | 83/881 |
| 6,302,602 B1 | | 10/2001 | Kiyohara et al. | |
| 6,334,675 B1 | | 1/2002 | Sanada et al. | 347/95 |
| 6,341,548 B1 | | 1/2002 | Hirahata et al. | 83/881 |
| 6,408,132 B1 | | 6/2002 | Ishikawa | |
| 6,491,361 B1 | | 12/2002 | Spann | |
| 6,554,511 B2 | | 4/2003 | Kwasny et al. | |
| 6,594,026 B2 | | 7/2003 | MacDonald | 358/1.12 |
| 6,619,166 B2 | | 9/2003 | Miyazaki et al. | 83/13 |

(Continued)

*Primary Examiner*—Daniel J. Colilla
*Assistant Examiner*—Jill E. Culler
(74) *Attorney, Agent, or Firm*—Taylor & Aust

(57) ABSTRACT

An apparatus for perforating a sheet of media includes a perforation forming mechanism including at least one perforation device. The perforation forming mechanism is configured to drive the perforation device through the sheet of media to extend through the sheet of media by a distance.

3 Claims, 7 Drawing Sheets

U.S. PATENT DOCUMENTS

| | | | | |
|---|---|---|---|---|
| 6,694,854 | B2 | 2/2004 | Furuya | 83/879 |
| 6,926,400 | B2 | 8/2005 | Kelley | 347/104 |
| 2001/0054339 | A1 | 12/2001 | Nokelainen | |
| 2002/0113986 | A1 | 8/2002 | MacDonald | |
| 2003/0206211 | A1 | 11/2003 | Baron | 347/37 |
| 2004/0085422 | A1 | 5/2004 | Kelley | 347/101 |

* cited by examiner

PERFORATION FORMING MECHANISM FOR USE IN AN IMAGING APPARATUS

BACKGROUND OF THE INVENTION

1. Field of the Invention

The present invention relates to perforating a sheet of media, and, more particularly, to a perforation forming mechanism for use in an imaging apparatus.

2. Description of the Related Art

Various devices are available for performing perforation and/or cutting operations. However, many such devices are used in commercial applications, and are generally cost prohibitive to lower volume users. Also, such devices are often standalone devices, requiring the purchase of additional hardware. While some efforts have been directed to incorporating perforation or cutting devices into an imaging device, there still exists a need for a versatile imaging apparatus that enables low volume users to enjoy the benefits of perforation.

SUMMARY OF THE INVENTION

The invention, in one form thereof, relates to an apparatus for perforating a sheet of media. A perforation forming mechanism includes at least one perforation device. The perforation forming mechanism is configured to drive the at least one perforation device through the sheet of media to extend through the sheet of media by a distance. A controller is coupled to the perforation forming mechanism, the controller being configured to select the distance.

In another form thereof, the invention relates to an apparatus including a mid-frame for supporting the back side of a sheet of media. A carrier system is configured to transport a carriage in a reciprocating manner with respect to the mid-frame. The carriage includes a bay. A perforation cartridge is configured to be received in the bay, the perforation cartridge containing a perforation forming mechanism.

In another form thereof, the invention relates to a perforation cartridge that is configured to be received in a bay of a printer carriage. The perforation cartridge contains a perforation forming mechanism including a perforation device.

In another form thereof, the invention relates to an apparatus for perforating a sheet of print media having a front side and a back side. A perforation forming mechanism includes at least one perforation device. A mid-frame supports the back side of the sheet of print media. The mid-frame includes a trough for receiving the perforation device.

In another form thereof, the invention relates to an apparatus for perforating a sheet of print media. The apparatus includes a printhead carriage for carrying a printhead. A perforator carriage carries a perforation forming mechanism. An isolation damper couples the printhead carriage to the perforator carriage.

In another form thereof, the invention relates to an apparatus including a perforation forming mechanism including a perforation device for forming perforations in a media sheet. A controller is coupled to the perforation forming mechanism. The controller is configured to select at least one of a vertical perforation resolution and a horizontal perforation resolution of the apparatus.

In another form thereof, the invention relates to an imaging apparatus. The imaging apparatus includes a perforation forming mechanism, which in turn includes a perforation device for forming perforations in a media sheet. A controller is coupled to the perforation forming mechanism. The controller is configured to control the perforation forming mechanism to create Braille indicia on the media sheet.

In another form thereof, the invention relates to an apparatus for perforating a sheet of print media having a front side and a back side. The apparatus includes a carrier system including a carriage and a drive unit for driving the carriage in a reciprocating manner over the sheet of print media. A perforation forming mechanism is mounted to the carriage for reciprocation with the carriage. The perforation forming mechanism includes at least one perforation device. The perforation forming mechanism is configured to drive the at least one perforation device through the sheet of print media to extend through the sheet of print media by a distance.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DETAILED DESCRIPTION OF THE INVENTION

Figure 1:
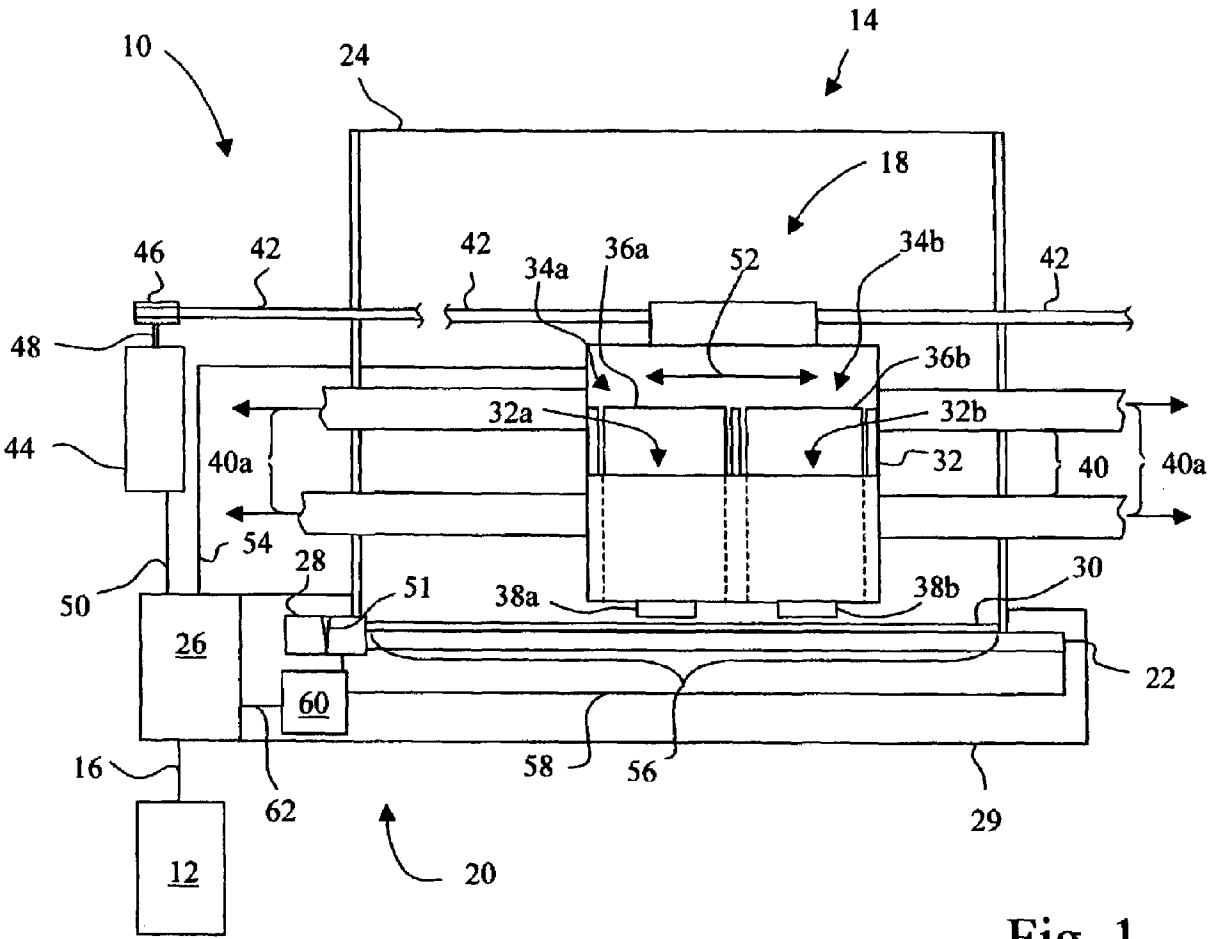
FIG. 1 is a diagrammatic representation of an imaging system employing an embodiment of the present invention.

Referring now to the drawings and particularly to FIG. 1, there is shown an imaging system 10 employing an embodiment of the present invention. Imaging system 10 includes a computer 12 and an imaging apparatus in the form of an ink jet printer 14. Computer 12 is communicatively coupled to ink jet printer 14 by way of communications link 16. Communications link 16 may be, for example, a wired connection, an optical connection, such as an optical or r.f. connection, or a network connection, such as an Ethernet Local Area Network.

Computer 12 is typical of that known in the art, and may include a monitor to display graphics or text, an input device such as a keyboard and/or mouse, a microprocessor and associated memory, such as random access memory (RAM), read only memory (ROM) and a mass storage device, such as CD-ROM or DVD hardware. Resident in the memory of computer 12 is printer driver software. The printer driver software places print data and print commands in a format that can be recognized by ink jet printer 14.

Ink jet printer 14 includes a carrier system 18, a feed roller unit 20, a mid-frame 22, a media source 24, a controller 26 and a perforator maintenance station 28. Carrier system 18, feed roller unit 20, mid-frame 22, media source 24, controller 26 and perforator maintenance station 28 are coupled, e.g., mounted, to an imaging apparatus frame 29.

Media source 24 is configured and arranged to supply from a stack of print media a sheet of print media 30 to feed roller unit 20, which in turn further transports the sheet of print media 30 during a printing operation and/or a perforation operation.

Carrier system 18 includes a carrier 32, i.e., carriage, that is configured with one or more bays, for example bay 32*a* and bay 32*b*. Each of bays 32*a*, 32*b* is mechanically and electrically configured to mount, carry and facilitate one or more types of cartridges, such as a monochrome printhead cartridge 34*a* and/or a color printhead cartridge 34*b*, and/or a perforator cartridge 34*c* (see FIGS. 2A–2D). Monochrome printhead cartridge 34*a* includes a monochrome ink reservoir 36*a* provided in fluid communication with a monochrome ink jet printhead 38*a*. Color printhead cartridge 34*b* includes a color ink reservoir 36*b* provided in fluid communication with a color ink jet printhead 38*b*. Alternatively, ink reservoirs 36*a*, 36*b* may be located off-carrier, and coupled to respective ink jet printheads 38*a*, 38*b* via respective fluid conduits. Perforator cartridge 34*c* is sized and configured to be mechanically and electrically compatible with the configuration of at least one of the printhead cartridges 34*a*, 34*b* so as to be interchangeable therewith in carriage 32, and includes a perforation forming mechanism 39.

Carriage 32 is guided by a pair of guide members 40. Either, or both, of guide members 40 may be, for example, a guide rod, or a guide tab formed integral with imaging apparatus frame 29. The axes 40*a* of guide members 40 define a bi-directional scanning path 52 of carriage 32. Carriage 32 is connected to a carrier transport belt 42 that is driven by a carrier motor 44 via a carrier pulley 46. In this manner, carrier motor 44 is drivably coupled to carriage 32 via carrier transport belt 42, although one skilled in the art will recognize that other drive coupling arrangements could be substituted for the example given, such as for example, a worm gear drive. Carrier motor 44 can be, for example, a direct current motor or a stepper motor. Carrier motor 44 has a rotating motor shaft 48 that is attached to carrier pulley 46. Carrier motor 44 is coupled, e.g., electrically connected, to controller 26 via a communications link 50.

Perforator maintenance station 28 includes an abrasive member 51, such as a ceramic material, arranged to receive and sharpen a perforation device, such as for example, a needle or a blade.

At a directive of controller 26, carriage 32 is transported in a controlled manner along bi-directional scanning path 52, via the rotation of carrier pulley 46 imparted by carrier motor 44. During printing, controller 26 controls the movement of carriage 32 so as to cause carriage 32 to move in a controlled reciprocating manner, back and forth along guide members 40. In order to conduct perforator maintenance operations, e.g., sharpening, controller 26 controls the movement of carriage 32 to position printhead carrier in relation to perforator maintenance station 28. The ink jet printheads 38*a*, 38*b*, or alternatively perforation forming mechanism 39, are electrically connected to controller 26 via a communications link 54. Controller 26 supplies electrical address and control signals to ink jet printer 14, and in particular, to the ink jetting actuators of ink jet printheads 38*a*, 38*b*, to effect the selective ejection of ink from ink jet printheads 38*a*, 38*b*, or to perforation forming mechanism 39 to effect the selective actuation of perforation forming mechanism 39.

During a printing operation, the reciprocation of carriage 32 transports ink jet printheads 38*a*, 38*b* across the sheet of print media 30 along bi-directional scanning path 52, i.e., a scanning direction, to define a print zone 56 of ink jet printer 14. Bi-directional scanning path 52, also referred to as scanning direction 52, is parallel with axes 40*a* of guide members 40, and is also commonly known as the horizontal direction. During each scan of carriage 32, the sheet of print media 30 is held stationary by feed roller unit 20. Feed roller unit 20 includes a feed roller 58 and a drive unit 60. The sheet of print media 30 is transported through print zone 56 by the rotation of feed roller 58 of feed roller unit 20. A rotation of feed roller 58 is effected by drive unit 60. Drive unit 60 is electrically connected to controller 26 via a communications link 62.

Figure 2A:
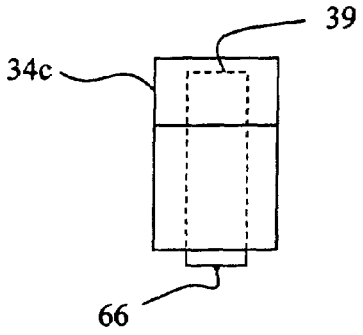
FIG. 2A shows an end view of an embodiment of the perforator cartridge of the present invention.
Figure 2B:
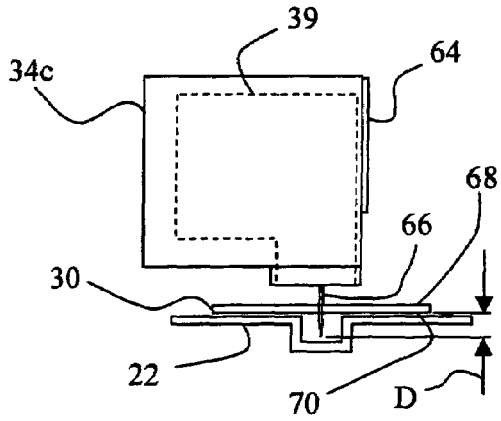
FIG. 2B shows a side view of the perforator cartridge of FIG. 2A.

FIG. 2A shows an end view of an embodiment of perforator cartridge 34*c*, including perforation forming mechanism 39. FIG. 2B shows a side view of an embodiment of perforator cartridge 34*c*, including perforation forming mechanism 39, and shows an electrical interface 64, such as a tape automated bonded (TAB) circuit.

Perforation forming mechanism 39 includes at least one perforation device 66, which may include one or more needles or blades used in forming perforations in the sheet of print media 30. FIG. 2A shows perforation device 66 with a single needle (or blade) exposed, but in a retracted position. FIG. 2B shows perforation device 66 in relation to the sheet of print media 30 having a front side 68 and a back side 70, with back side 70 being supported by mid-frame 22. As shown in FIG. 2B, perforation device 66 has one needle (or blade) exposed, and extending through the sheet of print media 30 by a distance D, as measured from the back side 70 of the sheet of print media 30. Distance D may be, for example, 0.1 millimeters or greater. Depending on the shape of perforation device 66, such as if perforation device is a tapered needle, the distance that perforation device 66 extends through the sheet of print media 30 can effect the size of the perforation opening. Thus, controller 26 may control perforation forming mechanism 39 to drive perforation device 66 at selectable distances D in order to select a particular perforation opening size. Further, by controlling the distance D, perforation forming mechanism 39 can be used to create Braille indicia on the sheet of print media 30, which may be, for example, a transparency sheet or paper. For example, when perforation device 66 is driven through a transparency sheet, a volcano-shaped raised surface is formed on the back side of the transparency sheet.

Figure 2C:
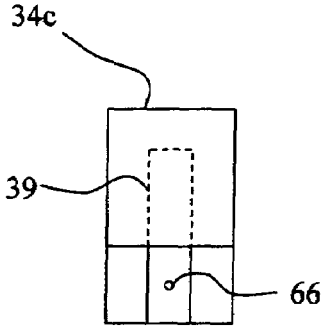
FIG. 2C shows a bottom view of one embodiment of the perforator cartridge of FIG. 2A.
Figure 2D:
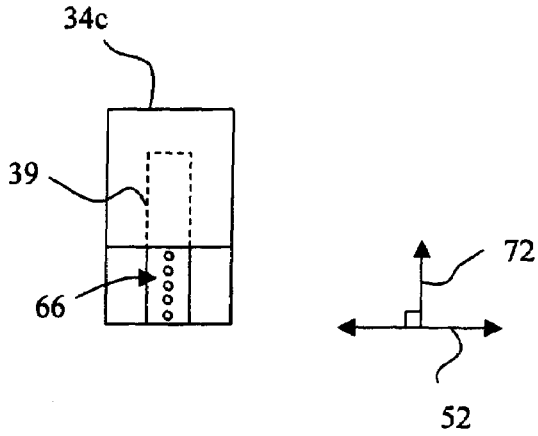
FIG. 2D shows a bottom view of another embodiment of the perforator cartridge of FIG. 2A.

Referring now to FIGS. 2C and 2D, perforation cartridge 34*c* can be configured having a single perforation device 66, as depicted in FIG. 2C, or alternatively, may be configured as depicted in FIG. 2D to have multiple perforation devices 66, e.g., multiple needles or blades, arranged, for example, in a column in a print media feed direction 72. Those skilled in the art will recognize that the multiple perforation devices 66 may be arranged in configurations other than a columnar arrangement, such as for example, slanted, staggered, curved, etc.

During a perforation operation, the reciprocation of carriage 32 transports perforator cartridge 34*c*, including perforation forming mechanism 39, across the sheet of print media 30 along bi-directional scanning path 52, i.e., a scanning direction, to define a perforation zone corresponding to print zone 56 of ink jet printer 14, and for convenience will also be referred to using the element number 56, i.e., perforation zone 56. The sheet of print media 30 is transported in print media feed direction 72 through perforation zone 56 by the rotation of feed roller 58 of feed roller unit 20.

Accordingly, in one embodiment, where perforation forming mechanism 39 has only a single perforation device 66, e.g., a single needle, then the maximum vertical perforation resolution (i.e., in a direction perpendicular to bi-directional scanning path 52, e.g., in print media feed direction 72) is limited to the minimum indexing distance of feed roller 58, while the horizontal perforation resolution (parallel to bi-directional scanning path 52) may be controlled to be as high as the horizontal printing resolution of printheads 38*a*, 38*b*, or lower. However, the extent of each perforation formed in the sheet of print media 30 may be increased by using a blade as perforation device 66. As used herein, the term perforation resolution refers to the maximum number of perforation holes in a given distance of the media, such as perforations per inch (ppi).

In another embodiment, where perforation forming mechanism 39 has multiple perforation devices 66, e.g., multiple needles or blades, arranged in a column in the print media feed direction 72, then the maximum vertical perforation resolution and the horizontal perforation resolution may be controlled to be a high as the printing resolution of printheads 38*a*, 38*b*, or lower.

Controller 26 is communicatively coupled to perforation forming mechanism 39 via communications link 54 and electrical interface 64 of perforation cartridge 34*c*. Controller 26 is configured, via hardware, firmware or software, to select either or both of the vertical perforation resolution and the horizontal perforation resolution. Such a selection may be based, for example, on media type (e.g., plain paper, photo paper, stickers, plastic, etc.), media thickness, or a resolution selected by a user. Alternatively, the perforation resolution may be established by computer 12, with perforation resolution commands or data being sent from computer 12 to controller 26.

Figure 3A:
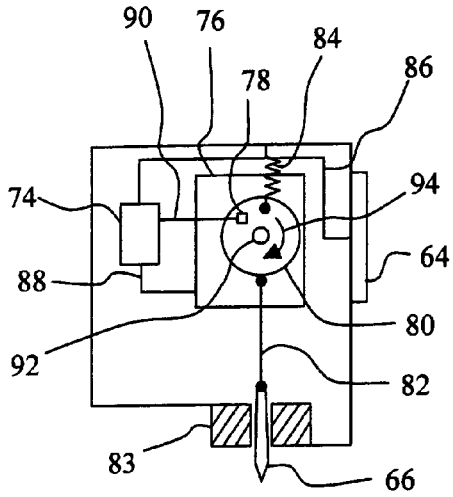
FIGS. 3A is a diagrammatic representation of one embodiment of a perforation forming mechanism for the perforation cartridge of FIG. 2A.
Figure 3B:
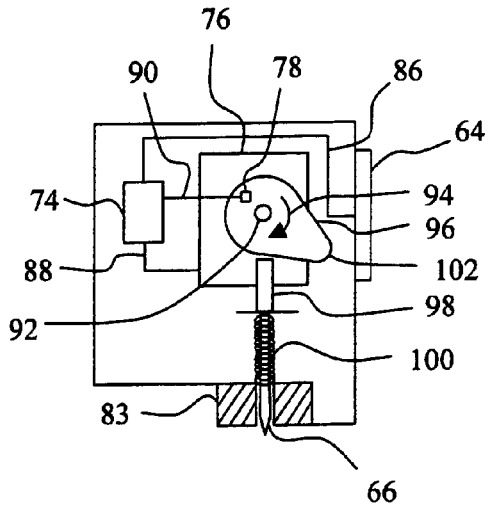
FIGS. 3B is a diagrammatic representation of another embodiment of a perforation forming mechanism for the perforation cartridge of FIG. 2A.
Figure 3C:
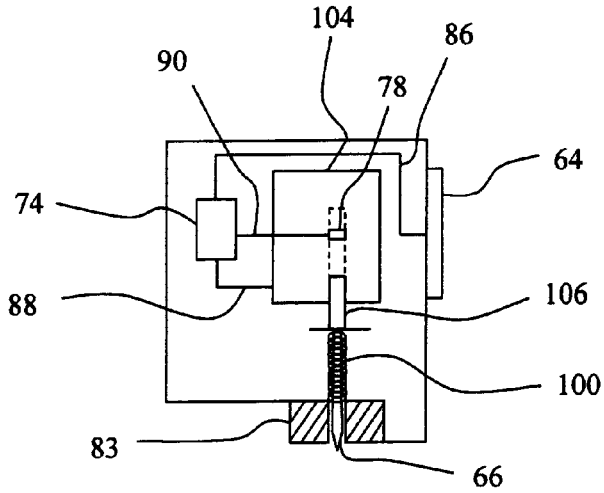
FIGS. 3C is a diagrammatic representation of another embodiment of a perforation forming mechanism for the perforation cartridge of FIG. 2A.

FIGS. 3A, 3B and 3C show three exemplary embodiments of perforation forming mechanism 39, each of which is discussed below.

FIG. 3A shows perforation forming mechanism 39 including, in addition to perforation device 66, a control circuit 74, a motor 76, a sensor 78, a flywheel 80, a linkage 82, a guide bushing 83, and a biasing spring 84. Electrical interface 64 of perforation cartridge 34*c* is connected to control circuit 74 via a communication link 86, such as for example, a multi-wire cable. Alternatively, electrical interface 64 can be formed on one side of a two layer printed circuit board, and control circuit 74 can be mounted on the opposite side of the printed circuit board. Also, control circuit 74 is connected to motor 76 via a communication link 88, and control circuit 74 is connected to sensor 78 via a communication link 90. Communications links 88 and 90 may be, for example, a multi-wire cable.

Motor 76 includes a shaft 92 connected to flywheel 80. Linkage 82 is pivotably coupled to each of flywheel 80 and perforation device 66. Guide bushing 83 establishes an orientation of perforation device 66, and provides a low friction inner guide surface that contacts perforation device 66. Also, the bottom surface of guide bushing 83 will release perforation device 66 from the sheet of print media 30 as the perforation device 66 is retracted into guide bushing 83, if the sheet of print media 30 become stuck to perforation device 66 during perforation.

A stroke of perforation device 66 may be established based on the location on flywheel 80 where linkage 82 is pivotably attached. As shown, a full rotation of flywheel 80, such as in the clockwise direction 94 as shown, will result in a full cycle of perforation device 66, e.g., from the fully retracted position to the fully extended position, and back to the fully retracted position. Alternatively, a full cycle of perforation device 66 may be performed, for example, by a clockwise half-rotation of flywheel 80 to extend perforation device 66 from the fully retracted position to the fully extended position, followed by a return counter-clockwise half-rotation to return perforation device 66 from the fully extended position to the fully retracted position. As a further alternative, by stopping the rotation of flywheel 80 before perforation device 66 has reached its fully extended position, the distance D that perforation device 66 extends through the sheet of print media 30 (see FIG. 2B) can be selectably controlled. Such control can be effected, for example, by configuring controller 26 to select distance D and control the stroke of perforation device 66 accordingly.

Sensor 78 senses a position of flywheel 80, such as a position indicia or feature representing a home (fully retracted) position. Alternatively, the position indicia, or feature, can be located near the home position, but not at the home position, such that sensor 78 is tripped just before flywheel 80 is at its home position. Also, it is contemplated that multiple position indicia or features may be established around flywheel 80, thereby providing a finer detection of the position of perforation device 66, and in turn, enabling better control over the position of perforation device 66. Such a position indicia or feature may be formed from a material having contrasting characteristics to that of the remainder of flywheel 80. For example, flywheel 80 may have a highly reflective finish except for the position indicia or feature, which has a light absorbing finish. Thus, sensor 78 supplies a signal to control circuit 74 so as to stop rotation of shaft 92 of motor 76, and in turn stop the rotation of flywheel 80, when sensor 78 senses the position indicia or feature on flywheel 80.

Biasing spring 84 is pivotably coupled to flywheel 80, and is located to aid the retention of flywheel 80 in the home position, and in turn, to aid the retention of perforation device 66 in its home (fully retracted) position.

FIG. 3B shows another embodiment of perforation forming mechanism 39, wherein flywheel 80, linkage 82, and biasing spring 84 of FIG. 3A is replaced with a cam 96, a cam follower 98 and a spring 100. Electrical interface 64 of perforation cartridge 34*c* is connected to control circuit 74 via communication link 86, such as for example, a multi-wire cable. Also, control circuit 74 is connected to motor 76 via communication link 88, and control circuit 74 is connected to sensor 78 via communication link 90.

Shaft 92 of motor 76 connected to cam 96. Cam follower 98 is coupled, e.g., connected to or integral with, perforation device 66. Guide bushing 83 establishes an orientation of perforation device 66, and provides a low friction inner guide surface that contacts perforation device 66. A stroke of perforation device 66 may be established based on the location of a cam lobe 102 on cam 96 in relation to cam follower 98. As shown, a full rotation of cam 96, such as in the clockwise direction 94 as shown, will result in a full cycle of perforation device 66, e.g., from the fully retracted position to the fully extended position, and back to the fully retracted position. Alternatively, a full cycle of perforation device 66 may be performed, for example, by a clockwise half-rotation of cam 96 to extend perforation device 66 from the fully retracted position to the fully extended position, followed by a return counter-clockwise half-rotation that returns perforation device 66 from the fully extended position to the fully retracted position. As a further alternative, by stopping the rotation of cam 96 before perforation device 66 has reached its fully extended position, the distance D that perforation device 66 extends through the sheet of print media 30 can be selectably controlled. Such control can be effected, for example, by configuring controller 26 to select distance D and control the stroke of perforation device 66 accordingly.

Sensor 78 senses a position of cam 96, such as a position indicia or feature representing a home (fully retracted) position. Such a position indicia or feature may be formed from a material having contrasting characteristics to that of the remainder of cam 96. For example, cam 96 may have a highly reflective finish except for the position indicia or feature, which has a light absorbing finish. Thus, sensor 78 supplies a signal to control circuit 74 so as to stop rotation of shaft 92 of motor 76, and in turn stop the rotation of cam 96, when sensor 78 senses the position indicia or feature on cam 96.

Spring 100 is positioned between cam follower 98 and guide bushing 83 to aid in biasing perforation device 66 in its home (fully retracted) position.

FIG. 3C shows another embodiment of perforation forming mechanism 39, wherein the motor 76 and cam follower 98 of FIG. 3B is replaced with a solenoid 104 and an armature 106. Electrical interface 64 of perforation cartridge 34*c* is connected to control circuit 74 via communication link 86, such as for example, a multi-wire cable. Also, control circuit 74 is connected to solenoid 104 via communication link 88, and control circuit 74 is connected to sensor 78 via communication link 90.

Armature 106 is displaced linearly upon the actuation of solenoid 104. Armature 106 is coupled, e.g., connected to or integral with, perforation device 66. Guide bushing 83 establishes an orientation of perforation device 66, and provides a low friction inner guide surface that contacts perforation device 66. A full cycle of perforation device 66 may be established based on the actuation of solenoid 104 to move perforation device 66 from the fully retracted position to the fully extended position, followed by the de-actuation of solenoid 104 to move perforation device 66 with the biasing aid of spring 100 back to the fully retracted position.

Sensor 78 senses a position of armature 106, such as a position indicia or feature representing a home (fully retracted) position. Such a position indicia or feature may be formed from a material having contrasting characteristics to that of the remainder of armature 106. For example, armature 106 may have a highly reflective finish except for the position indicia or feature, which has a light absorbing finish. Thus, sensor 78 supplies a signal to control circuit 74 to indicate when sensor 78 senses the position indicia or feature on armature 106.

In the various embodiments of FIGS. 3A–3C, sensor 78 will detect when perforation device 66 is not in the fully retracted (home) position, thereby indicating an error condition in the event that perforation device 66 gets stuck in the sheet of print media 30, e.g., remains out of its home position when controller 26 expects perforation device 66 to have returned to the home position.

Figure 4:
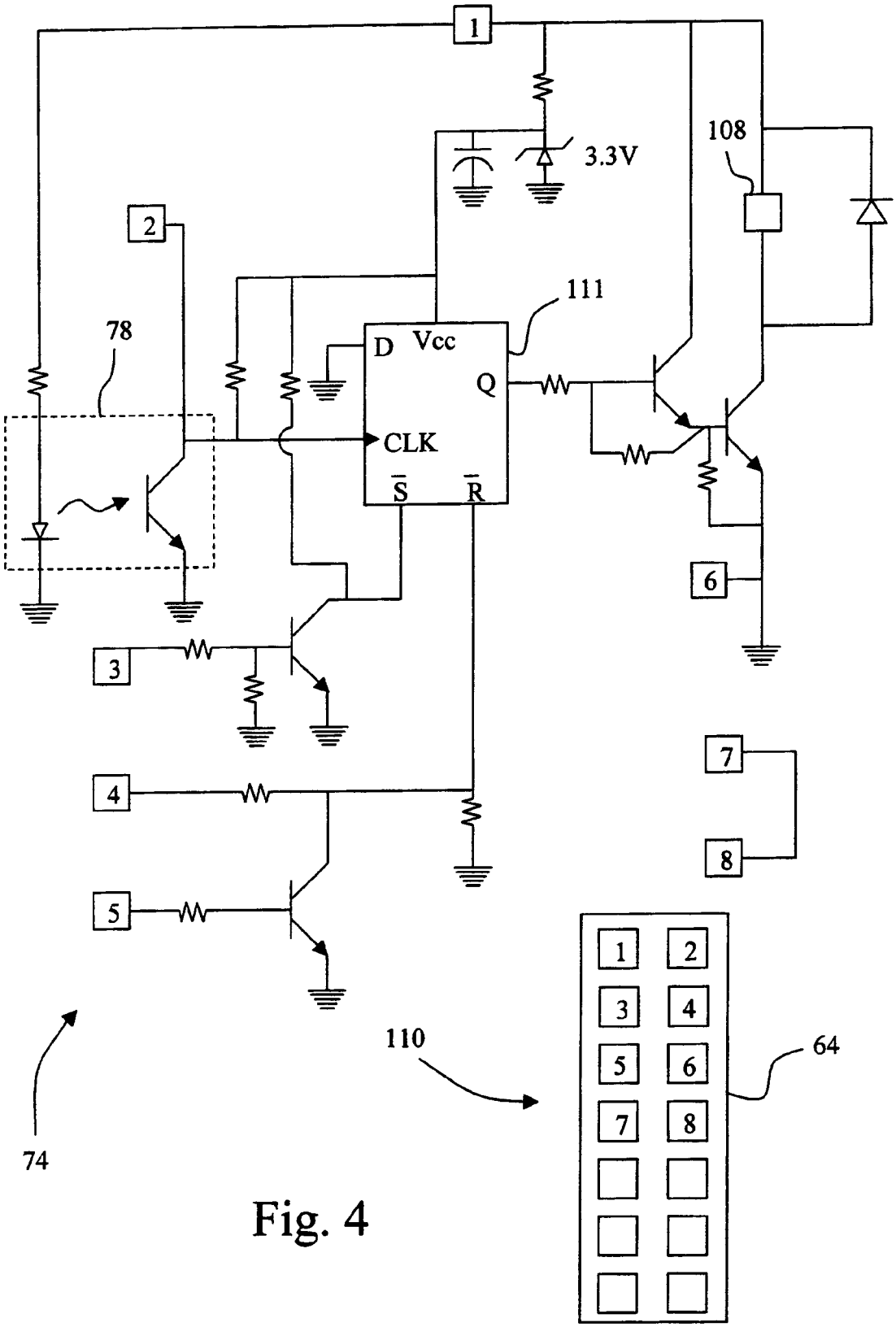
FIG. 4 is a circuit diagram of a control circuit that can be used in the various embodiments of the perforation forming mechanisms of FIGS. 3A–3C.

FIG. 4 is an exemplary circuit suitable for use as control circuit 74. Control circuit 74 includes sensor 78, various drive components, and a driven device 108. Driven device 108 represents motor 76 of the embodiments of FIGS. 3A and 3B, and represents solenoid 104 in the embodiment of FIG. 3C. As shown, electrical interface 64 includes a plurality of connection pads 110, with individual connection pads 110-1, 110-2, 110-3, 110-4, 110-5, 110-6, 110-7, and 110-8 being assigned connection points within control circuit 74. In control circuit 74, pads 110-7 and 110-8 are tied together, and in turn are used to indicate to controller 26 that cartridge 34*c* is in fact a perforation cartridge. Sensor 78 is used to supply a clock input to the D-flip-flop 111. Circuit power is supplied to control circuit 74 via pads 110-1 and 110-2. Controller 26 may set D-flip-flop 111 by supplying a signal to pad 110-3. Controller 26 may reset D-flip-flop 111 by supplying appropriate signals to pads 110-4 and 110-5. Circuit ground may be established, or may be monitored, via pad 110-6. Other aspects of the operation of control circuit 74, as shown in FIG. 4, are readily understood by one skilled in the art, and will not be further discussed herein.

Figure 5A:
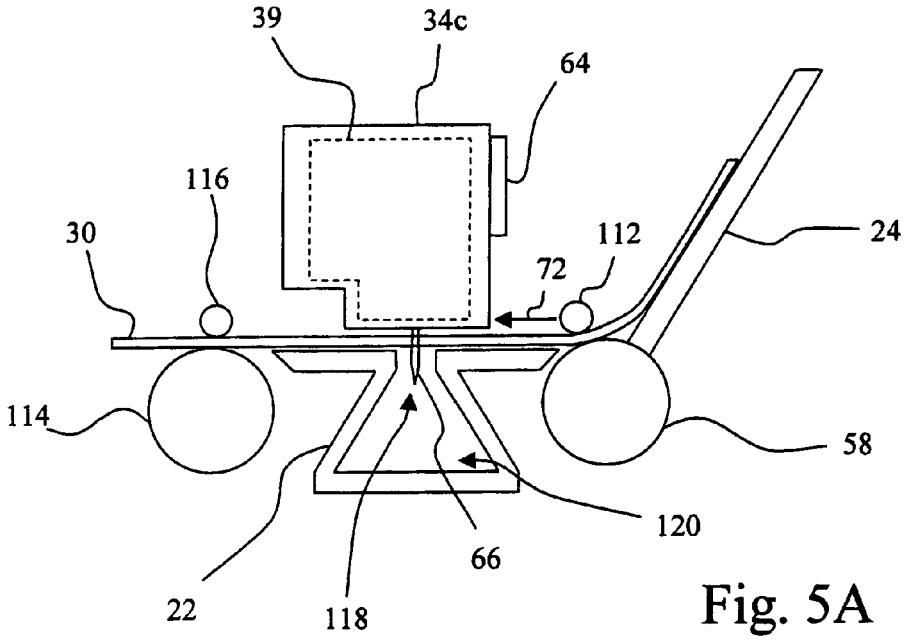
FIG. 5A is a side diagrammatic view of the mid-frame region of the imaging apparatus of FIG. 1.

FIG. 5A shows a side diagrammatic view of a portion of printer 14, illustrating a perforation of the sheet of print media 30. As shown, the sheet of print media 30 is transported by feed roller 58 with the aid of its associated pinch roller 112, and by an exit roller 114 with the aid of an associated pinch roller 116. Thus, feed roller 58 is positioned upstream of perforation device 66, in relation to print media feed direction 72. In addition, exit roller 114 is positioned downstream of perforation device 66. As such, in one embodiment the sheet of print media 30 is suspended between feed roller 58 and exit roller 114 during perforation, as shown. Mid-frame 22 provides support for the sheet of print media 30 during perforation. Mid-frame 22 includes a trough 118 that extends along a width of mid-frame 22, e.g., an elongated opening that extends along perforation zone 56, for receiving perforation device 66 as perforation device 66 passes completely through the sheet of print media 30. Mid-frame 22, including trough 118, defines an interior region 120 that may be used for the accumulation of waste paper punch-outs generated during perforation. Trough 118 is configured with a depth such that perforation device 66 does not contact mid-frame 22, i.e., does not contact the bottom of trough 118, when perforation device 66 is at a fully extended position.

Figure 5B:
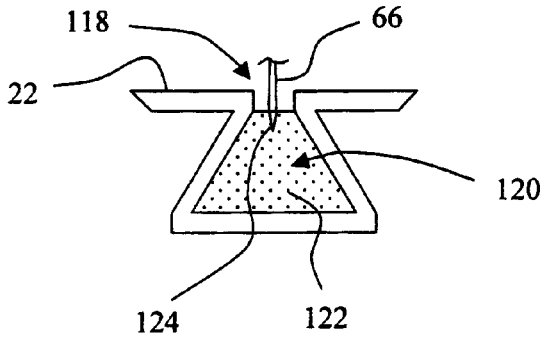
FIG. 5B is a side diagrammatic view showing another embodiment of the mid-frame of the imaging apparatus of FIG. 1.

Alternatively, as shown in FIG. 5B, interior region 120 may be substantially filled with a foam 122. Foam 122 may be positioned to receive at least a tip portion 124 of perforation device 66, thereby performing a cleaning of perforation device 66 after each perforation. Foam 122 may be, for example, a polyurethane foam or sponge. As a further alternative, interior region 120 may be completely filled with foam to provide support to back side 70 of the sheet of print media 30 at trough 118.

Figure 6:
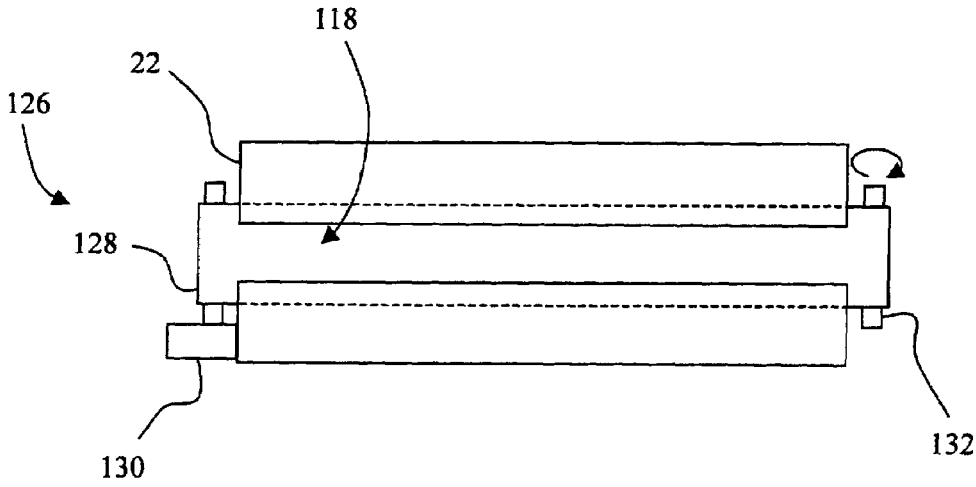
FIG. 6 is a top diagrammatic view showing still another embodiment of the mid-frame of the imaging apparatus of FIG. 1.

Referring now to FIG. 6, in relation to FIG. 5A, a conveyor unit 126 may be located in trough 118 in interior region 120 of mid-frame 22 to carry away the accumulation of waste paper punch-outs. Conveyer unit 126 includes a conveyor belt 128, a conveyor drive unit 130 and an idler unit 132. Conveyor belt 128 is suspended between conveyor drive unit 130 and an idler unit 132. Conveyor drive unit 130 provides a driving force to advance conveyor belt 128. Conveyor drive unit 130 may be, for example, a ratchet mechanism that increments conveyor belt 128 when conveyor drive unit 130 is engaged by carriage 32. Alternatively, conveyor drive unit 130 may be motor driven.

Figure 7:
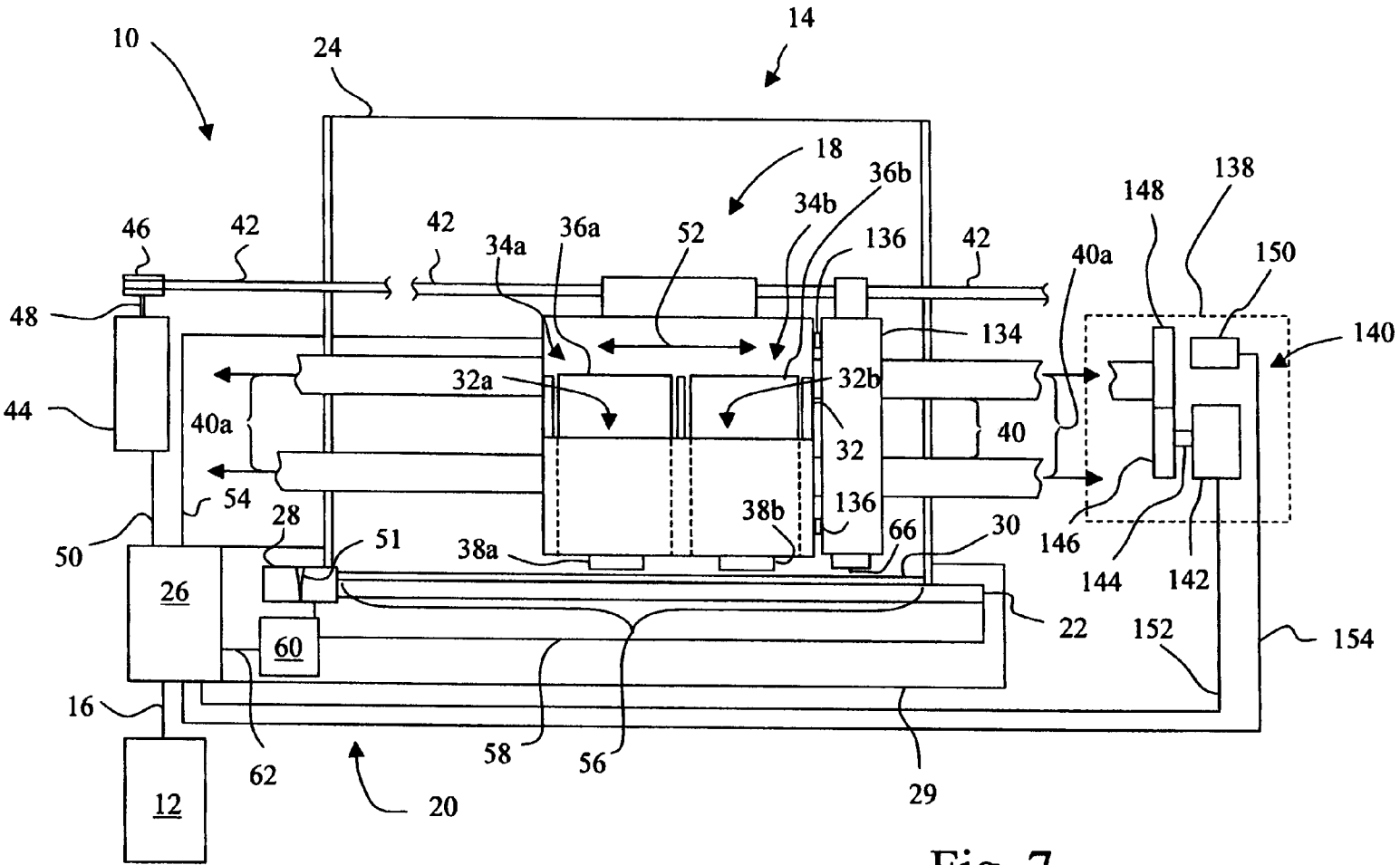
FIG. 7 is a diagrammatic representation of an imaging system employing another embodiment of the present invention.

FIG. 7 shows still another embodiment of the invention, which includes a dedicated perforator carriage 134. In this embodiment, carriage 32 may be a dedicated printhead carriage. The various configurations of the invention as shown in FIGS. 5A, 5B and 6, as well as the perforation operating characteristics described above, can also be readily incorporated into the embodiment of FIG. 7. Perforator carriage 134 is connected to carrier transport belt 42, and is coupled to carriage 32 by isolation members 136. Isolation members 136 may be made, for example, of rubber or other material having elastic, vibration absorbing, characteristics. Carrier transport belt 42 may also act as an isolation member. Perforator carriage 134 may be adapted to carry a perforation forming mechanism, such as for example one of the perforations forming mechanisms described above with respect to FIGS. 3A–3C, or another perforation mechanism known in the art. As shown, perforator carriage travels with carriage 32 carrying printheads 38*a*, 38*b* in a unitary manner. However, isolation members 136 serve as isolation dampers so that operation of the perforator mechanism in perforator carriage 134 will not transmit mechanical vibrations directly to carriage 32, and in turn to printheads 38*a*, 38*b*.

Alternatively, as shown in the breakout section 138, the perforation forming mechanism in perforator carriage 134 may be driven by a perforation drive system 140. Perforation drive system 140 includes a motor 142 having a shaft 144 to which a gear 146 is attached. A second gear 148 is attached to one of the guide members 40. This particular guide member may be a guide rod having a D-shaped cross section, which when rotated emulates the operation of cam 96 of FIG. 3B to drive perforation device 66. Gears 146, 148 are located to be in meshed relation. Also shown is a sensor 150 that is used to detect the home position of D-shaped shaft 40. Motor 142 is electrically connected to controller 26 via a communication link 152. Sensor 150 is electrically connected to controller 26 via communication link 154.

In this embodiment, controller 26 provides perforation commands to motor 142, which responds by rotating D-shaped guide member 40, which drives the perforation forming mechanism in perforator carriage 134, which in turn causes perforation device 66 to extend from its home position to its perforation position. Further rotation of D-shaped guide member 40 results in perforation device 66 returning to its retracted (home) position, wherein sensor 150 provides a signal to controller 26 to turn off motor 142 to stop rotation of D-shaped guide member 40.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for perforating a sheet of print media having a front side and a back side, comprising:

a printhead carriage for carrying a printhead;

a perforator carriage for carrying a perforation forming mechanism, wherein said perforation forming mechanism includes a perforation device;

an isolation damper coupling said printhead carriage to said perforator carriage; and a perforation maintenance station including an abrasive member for sharpening said perforation device at a location outside of a perforation zone of said perforation device.

2. An apparatus for perforating a sheet of print media having a front side and a back side, comprising:

a printhead carriage for carrying a printhead;

a perforator carriage for carrying a perforation forming mechanism;

an isolation damper coupling said printhead carriage to said perforator carriage; and a controller coupled to said perforation forming mechanism, said controller being configured to select at least one of a vertical perforation resolution and a horizontal perforation resolution of said apparatus.

3. An apparatus for perforating a sheet of print media having a front side and a back side, comprising:

a printhead carriage for carrying a printhead;

a perforator carriage for carrying a perforation forming mechanism;

an isolation damper coupling said printhead carriage to said perforator carriage;

a D-shaped guide rod for guiding said printhead carriage and said perforator carriage, said D-shaped guide rod being drivingly coupled to said perforation forming mechanism;

a motor coupled to said D-shaped guide rod; and a controller connected to said motor, said controller being configured to operate said motor so as to impart a rotation to said D-shaped guide rod to drive said perforation forming mechanism.

* * * * *